US007811215B2

(12) United States Patent
Wallach

(10) Patent No.: US 7,811,215 B2
(45) Date of Patent: Oct. 12, 2010

(54) MULTI-PURPOSE EXERCISE DEVICE

(76) Inventor: Mark Wallach, 27922 Golden Ridge La., San Juan Capistrano, CA (US) 92675

( * ) Notice: Subject to any disclaimer, the term of this patent is extended or adjusted under 35 U.S.C. 154(b) by 691 days.

(21) Appl. No.: 11/590,952

(22) Filed: Oct. 31, 2006

(65) Prior Publication Data

US 2007/0111869 A1 May 17, 2007

Related U.S. Application Data

(63) Continuation-in-part of application No. 10/902,773, filed on Jul. 30, 2004, now Pat. No. 7,128,700.

(51) Int. Cl.
*A63B 21/04* (2006.01)

(52) U.S. Cl. ..... 482/130; 482/142; 482/121

(58) Field of Classification Search ..... 482/121, 482/124, 126, 142, 140, 130
See application file for complete search history.

(56) References Cited

U.S. PATENT DOCUMENTS

| | | | | |
|---|---|---|---|---|
| 652,617 | A | 6/1900 | Hotz | |
| 5,665,040 | A | 9/1997 | Ho | |
| 5,700,232 | A | 12/1997 | Clausen et al. | |
| 5,911,535 | A | 6/1999 | Gvoich | |
| 6,110,081 | A * | 8/2000 | Barrett | 482/121 |
| 6,206,811 | B1 | 3/2001 | Lat | |
| 6,672,997 | B1 | 1/2004 | Winkler | |
| 6,676,576 | B1 | 1/2004 | Wu | |
| 6,866,617 | B2 | 3/2005 | Chen | |
| 2005/0075223 | A1 | 4/2005 | Wu | |
| 2005/0187082 | A1 | 8/2005 | Bowser | |
| 2005/0239618 | A1 | 10/2005 | Teng | |
| 2005/0245370 | A1 | 11/2005 | Boland | |
| 2005/0255976 | A1 | 11/2005 | Hinds et al. | |
| 2006/0025289 | A1 | 2/2006 | Wallach | |
| 2006/0089240 | A1 | 4/2006 | Yu | |

* cited by examiner

*Primary Examiner*—Jerome Donnelly
(74) *Attorney, Agent, or Firm*—Jones Day

(57) ABSTRACT

An exercise device capable of simultaneously exercising a plurality of muscle groups, which includes an exercise chair mounted to a base, the exercise chair having a pivotally-resistant seat back. The exercise device further includes large, curvilinear conduits through which pass adjustably-resistant elastic bands with grips fixedly attached to the elastic bands proximate the upper and lower ends of the curvilinear conduits, which curvilinear conduits are laterally spaced, one on each side of the exercise chair. The exercise device further includes a resistive foot platform positioned at the front end of the base, which resistive foot platform is moveably engaged with the exercise chair. The exercise device further includes a resistive seated-row grip positioned at the front end of the base that permits cardiovascular exercise. The exercise device further includes rotatable and rocking latches for quickly changing from between one or more differently-tensioned resistive elements.

9 Claims, 15 Drawing Sheets

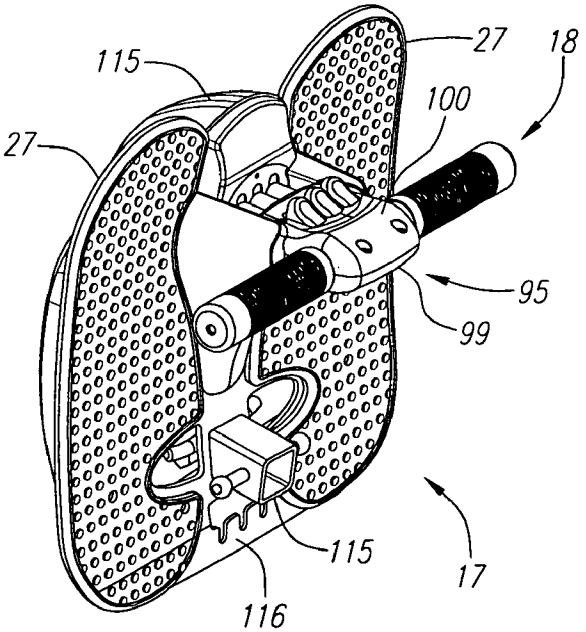
FIG. 19
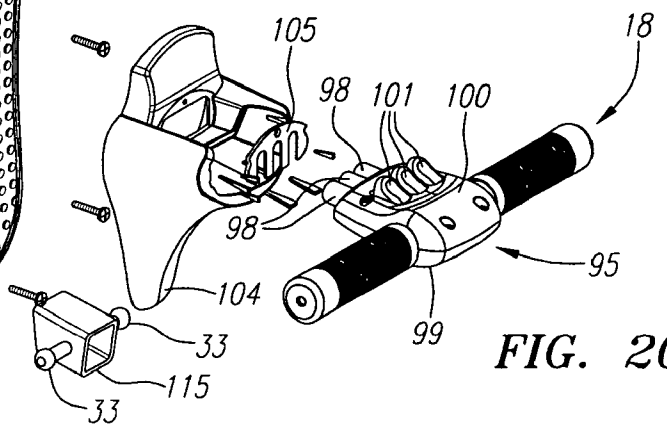
FIG. 20
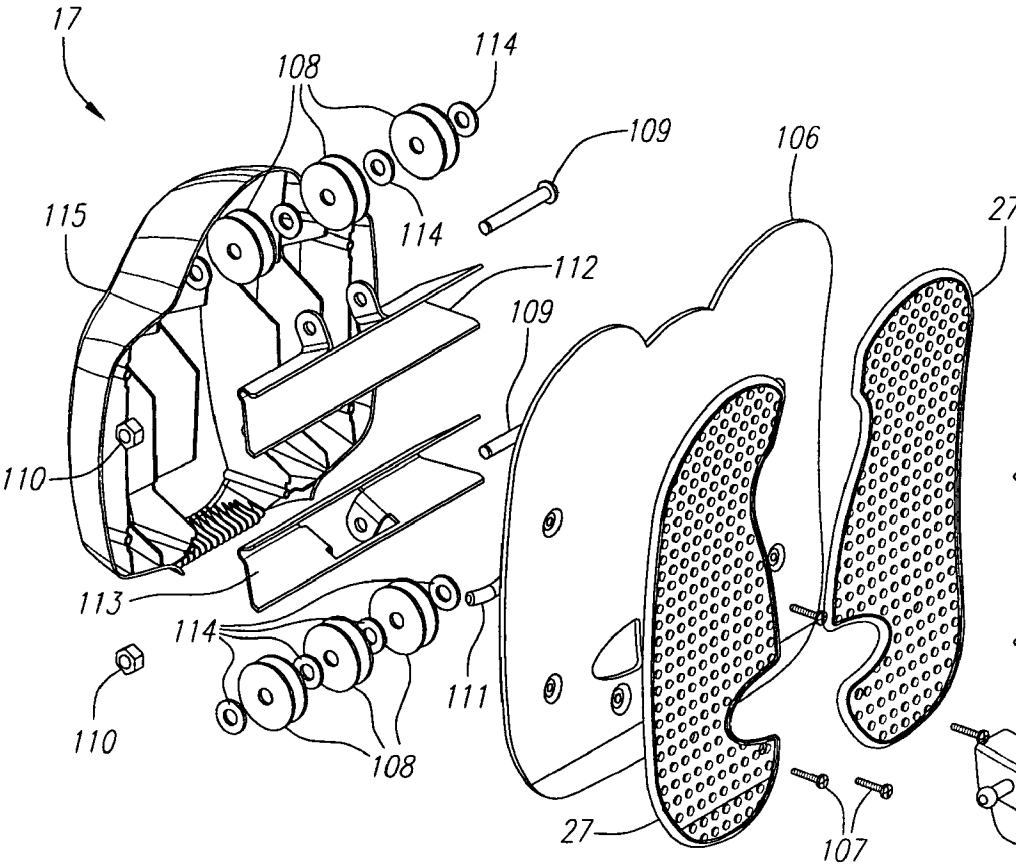

MULTI-PURPOSE EXERCISE DEVICE

CROSS REFERENCE TO RELATED APPLICATIONS

This application is a continuation-in-part of U.S. patent application Ser. No. 10/902,773, filed Jul. 30, 2004, now U.S. Pat. No. 7,128,700, the disclosure of which is hereby incorporated by reference as if set forth fully herein.

BACKGROUND OF THE INVENTION

The field of the present invention is exercise devices, specifically, an improved, adjustable exercise device capable of simultaneously and effectively exercising a plurality of muscle groups.

Devices that function to exercise various muscle groups are well-known in the art. In particular, exercise devices that use springs or other elastic material to provide resistance have been described previously. See, e.g, Reynolds (U.S. Pat. No. 5,176,601); Kuo (U.S. Patent Application Publication No. US 2004/0002412 A1); and Kuo et al. (U.S. Patent Application Publication No. US 2004/0038786 A1). By and large, these devices permit a user to exercise a given muscle group, the arm muscles for instance, by using a handle or other similar grip, attached to an elastic cord, spring, or some other similar means of providing resistance, such as weights. By pulling and releasing the handle on these devices, the user is able to exercise the specific muscle group meant to be exercised by that particular handle/resistance combination. Some previously-described devices have handle/resistance combinations that are configured in such a way that the user can exercise different muscle groups, such as the leg or abdominal muscles, in addition to the arm muscles.

These devices, however, fail to achieve a design wherein the primary exercise components are strategically located and positioned such that the user can simultaneously, efficiently, and effectively exercise multiple muscle groups, such as those of the arms, legs, back, and/or abdomen, all while maintaining a single, uninterrupted exercise routine. This is because, among other reasons, these devices require the user to stop exercising or otherwise interrupt the exercise routine in order to change or alter the configuration of the device, so as to alternate between exercises of the various muscle groups. Other of these exercise devices simply lack placement of the exercise components in such a way as to allow an uninterrupted exercise routine, or else they do not permit the full range of possible movements necessary to achieve a complete and thorough exercise workout.

For example, the devices described by Kuo (referenced above) and Kuo et al. (referenced above) have handles that necessarily must rest on the floor while not in use. Thus, for instance, it is not possible for a user to begin an exercise routine by exercising only the abdominal muscles, and to subsequently begin exercising the arms, without stopping the abdominal exercise routine in order to initiate arm exercises. The Kuo, and Kuo et al. devices further lack a feature or means to easily adjust the resistance applied to the handles during arm and back muscles exercise. In addition, while Reynolds (referenced above) describes a device that permits simultaneous exercise of the arm and leg muscles, the possible arm movements are severely limited, inasmuch as the device only permits linear motion of the arms, which consequently limits the number of arm muscle groups that can be effectively exercised. In addition, like the Kuo devices, the Reynolds device requires the user to stop exercising and make adjustments to the position of the handles before all the possible arm exercise movements can be achieved. Nor does the Reynolds device possess a separate resistance element meant to exercise the abdominal muscles, but rather possesses no mechanism by which the abdominal muscles can be stressed by independent resistance.

Barrett (U.S. Pat. No. 6,110,081) describes a device that consists of a pair of hollow, tightly-curved tubes through which elastic cords are passed, with handles attached to each end of the elastic cords. Since the curvature radius of the tubes on this device is small, the handles are necessarily located in very close proximity to the frame of the device. As a result, the user's full potential range of handle movement during exercise is impeded. That is, as a necessary consequence of the tight and short curvature of the tubes in this device, the presence of the frame and/or the tubes themselves interfere with the user's ability to move his or her arms through a full range of motion during exercise. Consequently, the user cannot achieve a complete and thorough workout of the arm muscles. Also, because the curvature radius is small, the elastic cord must pass through a tight turn while the cord is moving through the tube during exercise, thus causing friction between the elastic cord and the hollow tube, which in turn increases cord wear and decreases its effective life span.

The design of the Barrett device also does not permit the user to exercise his or her abdominal muscles by way of an independent elastic element. Any such abdominal exercise can only be achieved by doing a sit-up type exercise in conjunction with the elastically-resistant handles, and it is not possible to readily alter this device to include a separate elastic element for abdominal exercises. Nor does this device permit ease of transition between arm exercises, but rather requires the user to stop exercising and make large scale adjustments to the device and/or alter the device's position prior to initiating such exercises.

Other devices described in the art possess a feature whereby the user can exercise his or her abdominal muscles. These devices typically employ an elastic member that creates resistance to user movement, either by compression or stretching of the elastic member. See, e.g., Cayne (U.S. Pat. No. 5,882,284). However, these devices employ an elastic member that provides resistance when the user moves in a forward direction. Further, these devices fail to disclose a design that provides adequate or proper back support during the movements required to exercise the abdominal muscles. Nor do they disclose a design whereby the muscles of the arms, legs, and back can be exercised while simultaneously exercising the abdominal muscles. In addition, while some of the devices described in the preceding paragraphs above contain designs that permit exercise of the abdominal muscles, they possess the limitations and drawbacks as previously discussed, including but not limited to lack of ease of transition between exercises, limited range of arm exercise motion, lack of a specific resistance element for abdominal exercises, and/or lack of adequate or proper back support.

SUMMARY OF THE PRESENT INVENTION

In view of the foregoing disadvantages and problems inherent in the devices disclosed in the prior art, the present invention is an improved exercise device that permits an adjustable, complete, and simultaneous workout of all major muscle groups of the arms, legs, back, and abdomen, while permitting the user to remain in a seated position. The present invention also permits the user to achieve an effective cardiovascular workout, and the invention folds and becomes compact for portability or storage.

As will be described in greater detail below, the present invention accomplishes the foregoing using a resistance-based system, in which hollow tubes or conduits forming large arcuate and/or curvilinear arms are laterally-spaced on either side of a seat that is mounted to a base frame. Long elastic bands are passed through the curvilinear arms, and handles or grips are attached at each end of the elastic bands, and are positioned such that one set of grips are located above the seat, and still another set of grips is located below the seat. The length of tubing or conduits forming the curvilinear arms can be altered, such that the amount of resistance exerted by the bands can be increased or decreased as desired by the user. A pivotal seat back is affixed to the seat, and a spring or other resistive element provides a force that is resistant to the backward movement of the seat back while the user is positioned in the seat. A moveable foot platform is attached to the forward section of the base, which platform also utilizes adjustable, resistive bands to provide resistance during movement, thus permitting exercise of the leg muscles. Another moveable handle or grip is attached to the forward section of the base by way of an elastic band which passes through another hollow tube or rail that runs longitudinally beneath the seat and around rollers mounted on the top portion of the foot platform. This grip permits the user to perform a resistance-based seated-row exercise, thus allowing the user to additionally increase the user's heart rate and achieve a cardiovascular workout, in addition to the other exercises of the arms, legs, back, and abdomen. One or more elastic bands are readily selected by way of a rotatable or rocking latching mechanism that engages with heads connected to the elastic bands.

In addition to the objects and advantages stated above that are apparent or inherent, or which otherwise become apparent or are inherent hereinafter, one of the objects and advantages of the present invention is proper, functional placement of the resistant grips and foot platform, with respect to the resistant seat back, such that the user can perform a single exercise routine, and readily alternate between exercises, in a way that permits continuous exercise of all possible muscle groups without interrupting or stopping the exercise routine, all while maintaining one central, seated position. This is achieved by the laterally-spaced, large arcuate or curvilinear arms, with its plurality of handle or grip sets, one set of grips being located above the seat and the other being located below the seat. Because of the large curve of the tubing or conduits, and because they are adequately spaced apart from the seat, the user is able to grasp any one or two of the four grips, in a variety of different combinations, and exercise the user's various arm and back muscle groups, either in combination with, or separately from, exercise of the user's leg muscles using the foot platform, and/or the abdominal muscles using the resistive seat back.

As a result of the strategic design and placement of the exercise components of the present invention, the user is able to begin any one exercise, and make continual changes and adaptations in the various combinations of possible exercise movements, while performing the entire exercise routine without interruption or stopping to change or alter the device itself. Thus, for example, the user can begin a workout gradually, by first performing abdominal exercises using the resistive seat back. Then, while continuing the abdominal exercises, the user can add arm exercises, either working one arm or both, in many various directions, including upwardly or downwardly, changing and adapting the arm movements as necessary according to the user's endurance level. Finally, while continuing the foregoing, the use can add leg muscle exercises using the foot platform, all without interrupting the single exercise routine.

Another object and advantage of the present invention is proper, functional placement of the resistant grips and foot platform, with respect to the resistant seat back, such that the user can perform all exercises in a manner that is unimpeded by the presence of the base, frame, or other components of the device itself. Also, the user can move the grips in an unlimited number of directions away from the curvilinear arms, whether in a linear or non-linear direction, which direction can be changed without interrupting or stopping the exercise routine. This is achieved by the laterally-spaced, large arcuate or curvilinear arms, with its plurality of handle or grip sets, one set of grips being located above the seat and the other being located below the seat. Because of the large curve of the tubing or conduits, and because they are adequately spaced apart from the seat, the user is able to freely make any number of small or large arm movements, and the frame and curvilinear arms do not impede such movements. As a result, and because the elastic is pliable, the user is able to move the grips in numerous linear, and non-linear directions away from the tubing or conduits, and the user is able to attain a thorough workout of the arm and back muscles, without being encumbered from moving the arms in any fixed direction, or in any certain manner. In addition, the curvilinear arms can be rotated outwardly to increase the lateral distance between the grips, so as to permit the user to perform butterfly-type arm exercises.

Yet another object and advantage of the present invention is unimpeded and smooth movement of the elastic bands through the length of the hollow tubing or conduits in order to attain a high level of operation efficiency, as well as to reduce wear of the elastic band and other device components. This is achieved as a result of the large radius of the arc used in the curvilinear arms. Because the radius is large, the elastic is not forced to pass through a tight turn during use, thus reducing resistance and increasing the smoothness of handle or grip operation, while decreasing wear of the affected components.

Yet another object and advantage of the present invention is a resistive element that is placed such that the abdominal muscles can be stressed independently, separate and apart from other resistive elements on the device, while providing adequate and proper back support for the user to prevent neck or other anatomical injury during stress of the abdominal muscles. This is achieved by using a relatively flat back support that is pivotally mounted to the seat, and which has its own resistive element, separate and apart from the resistive elements used to exercise the arm, leg, and back muscles. Further, the seat back is capable of approaching a horizontal or near-horizontal position, and the abdominal muscles are variously stressed, both during reclining of the seat back, as well as during inclining motions.

Yet another object and advantage of the present invention is resistance that can be readily increased or decreased in order to achieve the desired level of work for the user's muscle groups. For the resistive elements that exercise the arm muscles, this is achieved by extending the length of the curvilinear arms, such that the elastic bands that pass through the tubing or conduits are stretched to a greater degree prior to onset of exercise motion. Consequently, upon exercise motion, a greater amount of force must be exerted by the user to move the grips than if the curvilinear arms were extended to a lesser degree, or not extended at all. The foot platform is connected to an elastic band that passes internally through a hollow tube or rail, thus providing a constant resistive force. That resistive force can be altered by moving one end of an additional, external elastic band to various positions that are closer or farther away from the other end.

Yet another object and advantage of the present invention is a function that allows the user to achieve a cardiovascular workout. This is achieved by use of the elastically-resistant grip that is located proximate the foot platform. By pulling and releasing this grip, the user is able to engage in a rowing-type activity, thus effecting a substantial increase in user heart rate and allowing cardiovascular exercise.

Yet another object and advantage of the present invention is foldability, such that the device can be easily transported or stored in a compact manner.

Yet another object and advantage of the present invention is a mechanism for easily switching between variously-tensioned resistive elements or elastic bonds.

The foregoing objects and advantages are not meant to be an exhaustive summary, inasmuch as further objects and advantages of this invention will be readily apparent to those skilled in the art from the following detailed description, taken independently or in conjunction with the annexed sheets of drawings, in which an embodiment of the invention is described and shown. The following detailed description and annexed drawings are provided only for purposes of illustration of one possible embodiment of the present invention, and not for purposes of limitation of the appended claims.

BRIEF DESCRIPTION OF THE DRAWINGS

The following detailed description of the invention can be better understood with reference to the accompanying drawings, wherein:

FIG. 19 is a perspective view of the seated row grip coupling mechanism joined with the foot platform, in accordance with the present invention.

FIG. 20 is an exploded view of the seated row grip coupling mechanism joined with the foot platform, in accordance with the present invention.

In the drawings, similar reference characters denote similar elements throughout the several views, as well as within the detailed description below.

DETAILED DESCRIPTION

As noted above, the following detailed description is not meant to limit the instant invention, inasmuch as alternate embodiments will be readily apparent to those skilled in the art.

Figure 1:
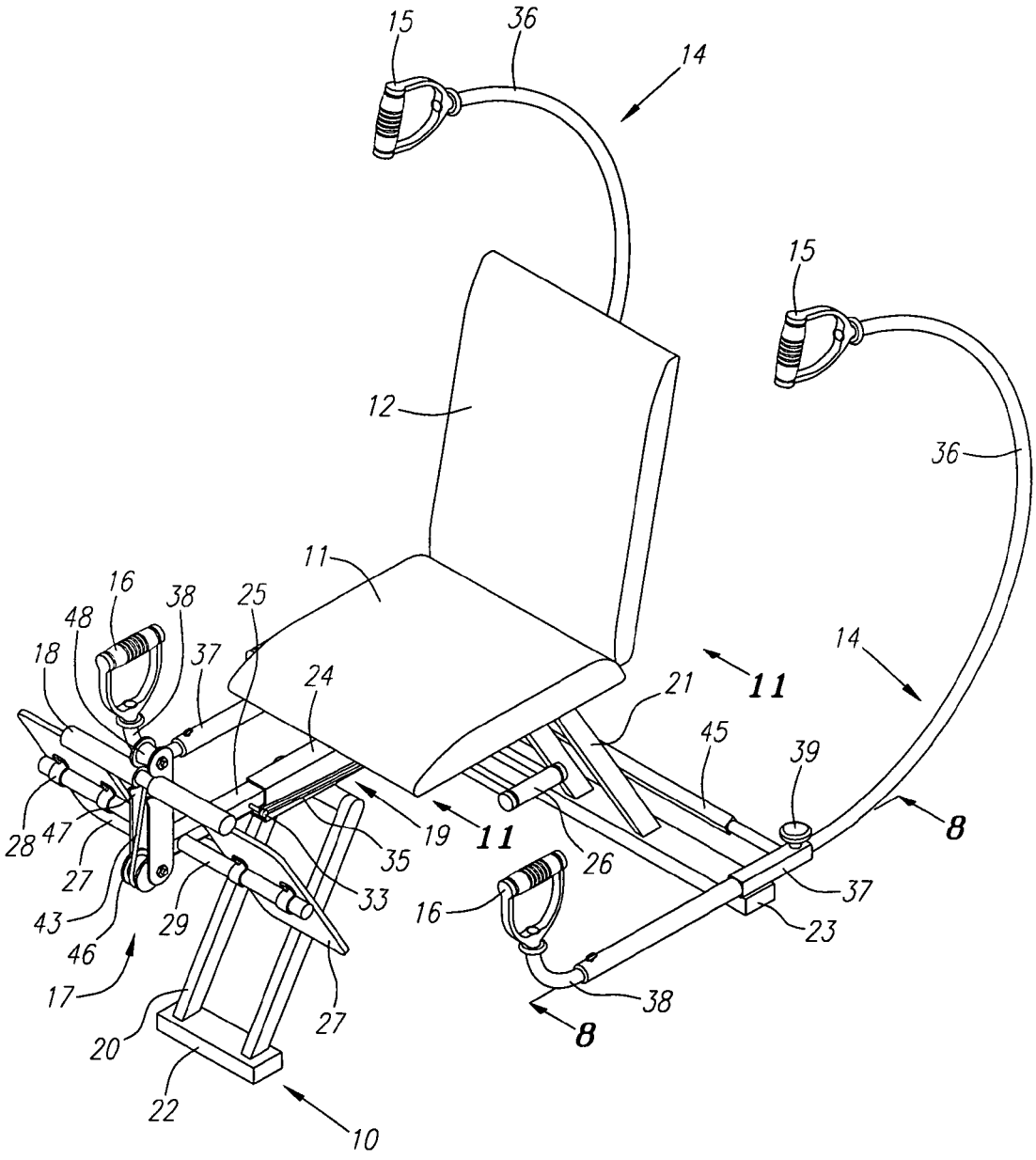
FIG. 1 is a front, perspective view of the exercise device in accordance with the present invention, showing the various exercise components of the device in a static position.
Figure 2:
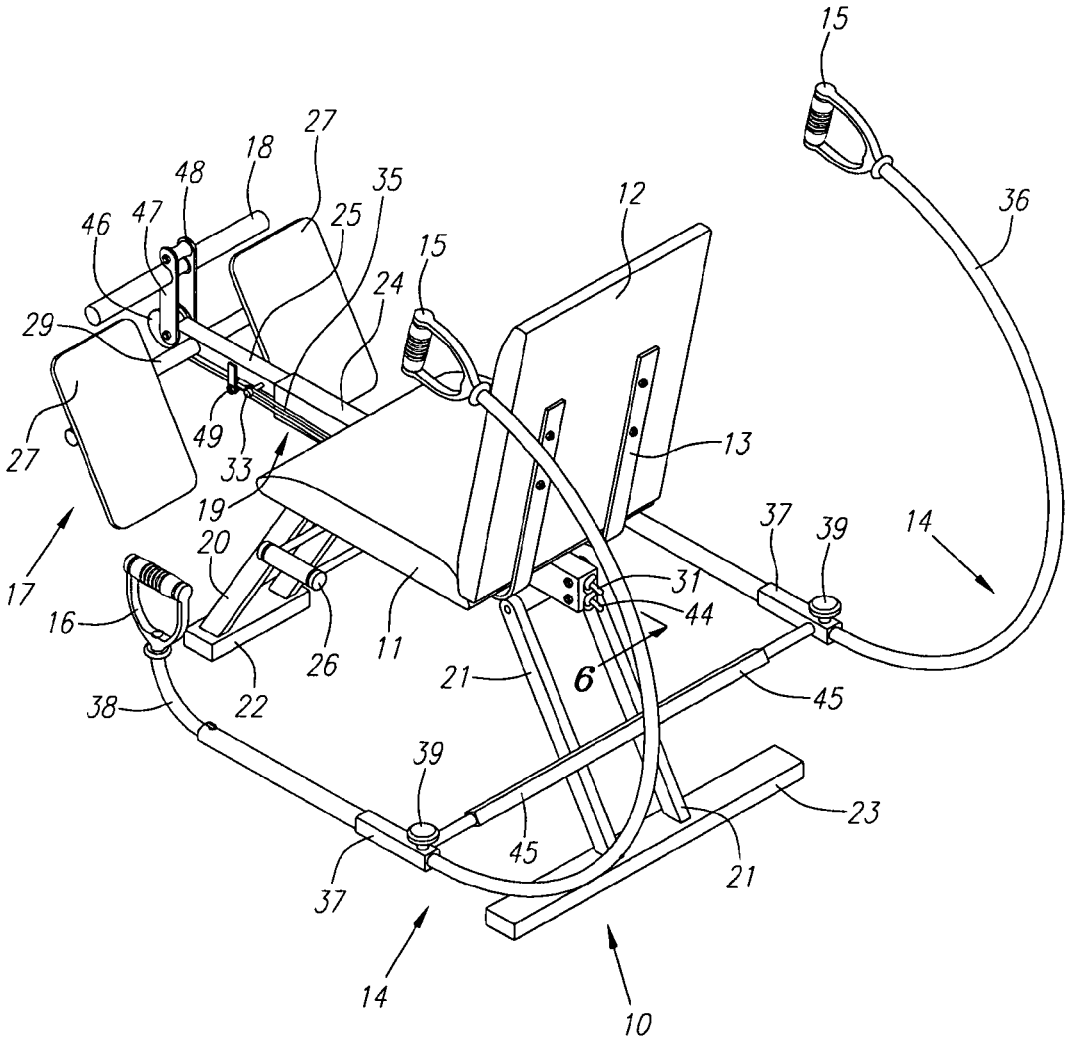
FIG. 2 is a rear, perspective view of the exercise device in accordance with the present invention, showing the various exercise components of the device in a static position.
Figure 3:
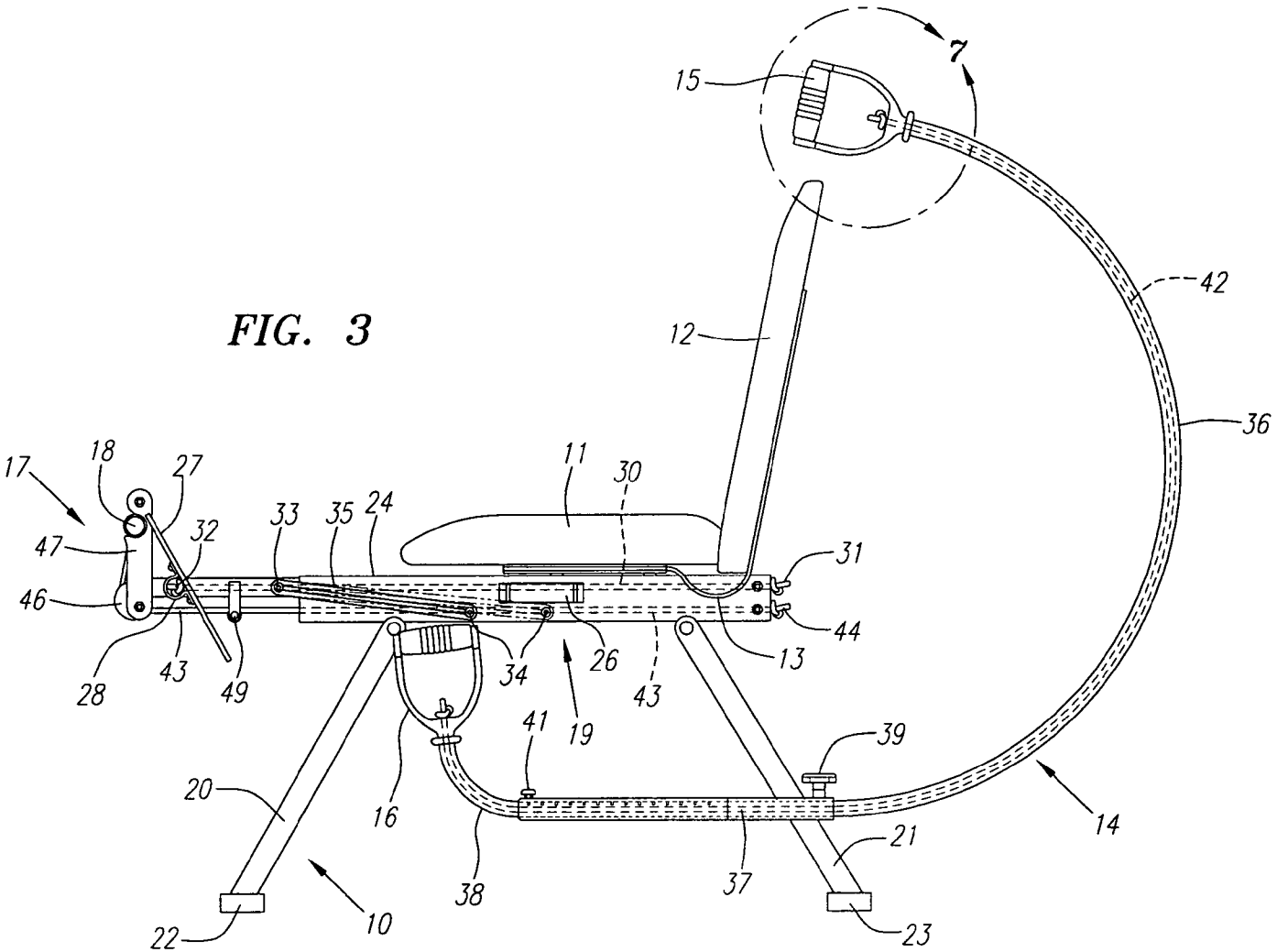
FIG. 3 is a side view of the exercise device in accordance with the present invention, with dashed lines representing the internal elastic bands that are connected to the foot platform and the seated-row grip, which bands pass through the length of the hollow longitudinal rail beneath the seat, with further dashed lines representing one of the internal elastic bands that passes through the length of the hollow curvilinear arms.
Figure 11:
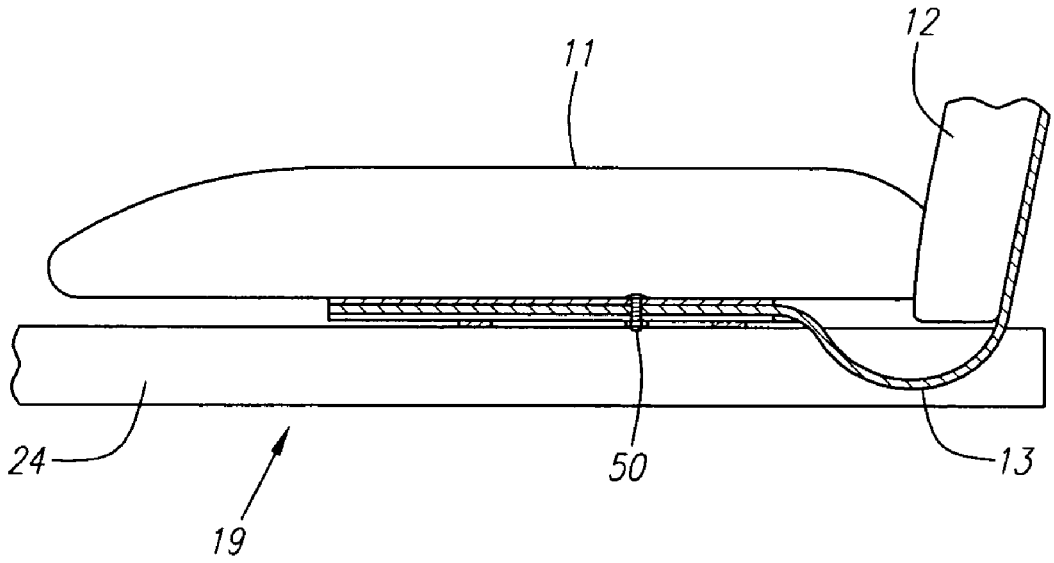
FIG. 11 is a side view of the seat, showing the resistive member that connects the seat back to the seat by way of a channel located directly underneath the seat. The channel in FIG. 11 is shown in cross-section along line 11-11 of FIG. 1.
Figure 13:
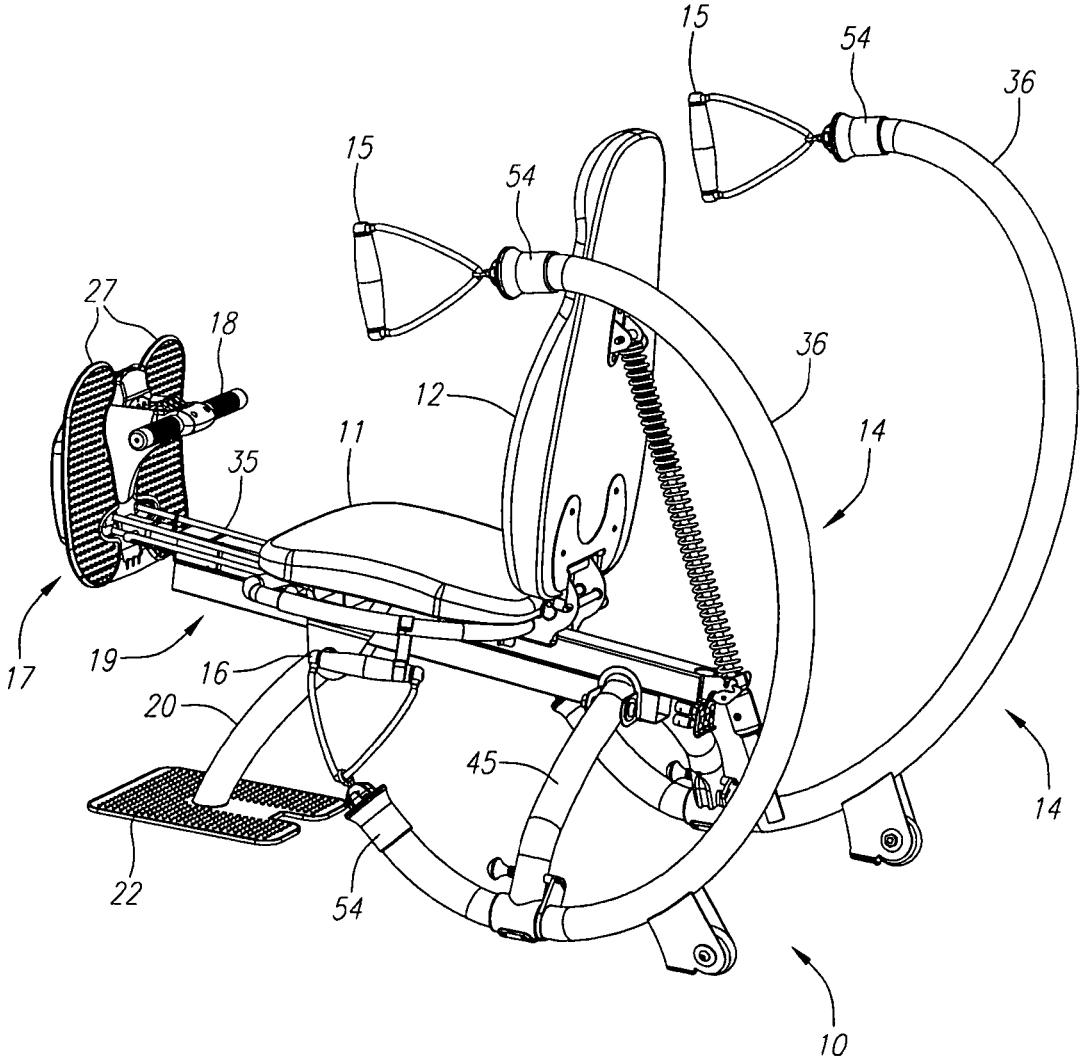
FIG. 13 is a perspective view of the exercise device in accordance with the present invention, showing the various exercise components of the device in a static position.
Figure 14:
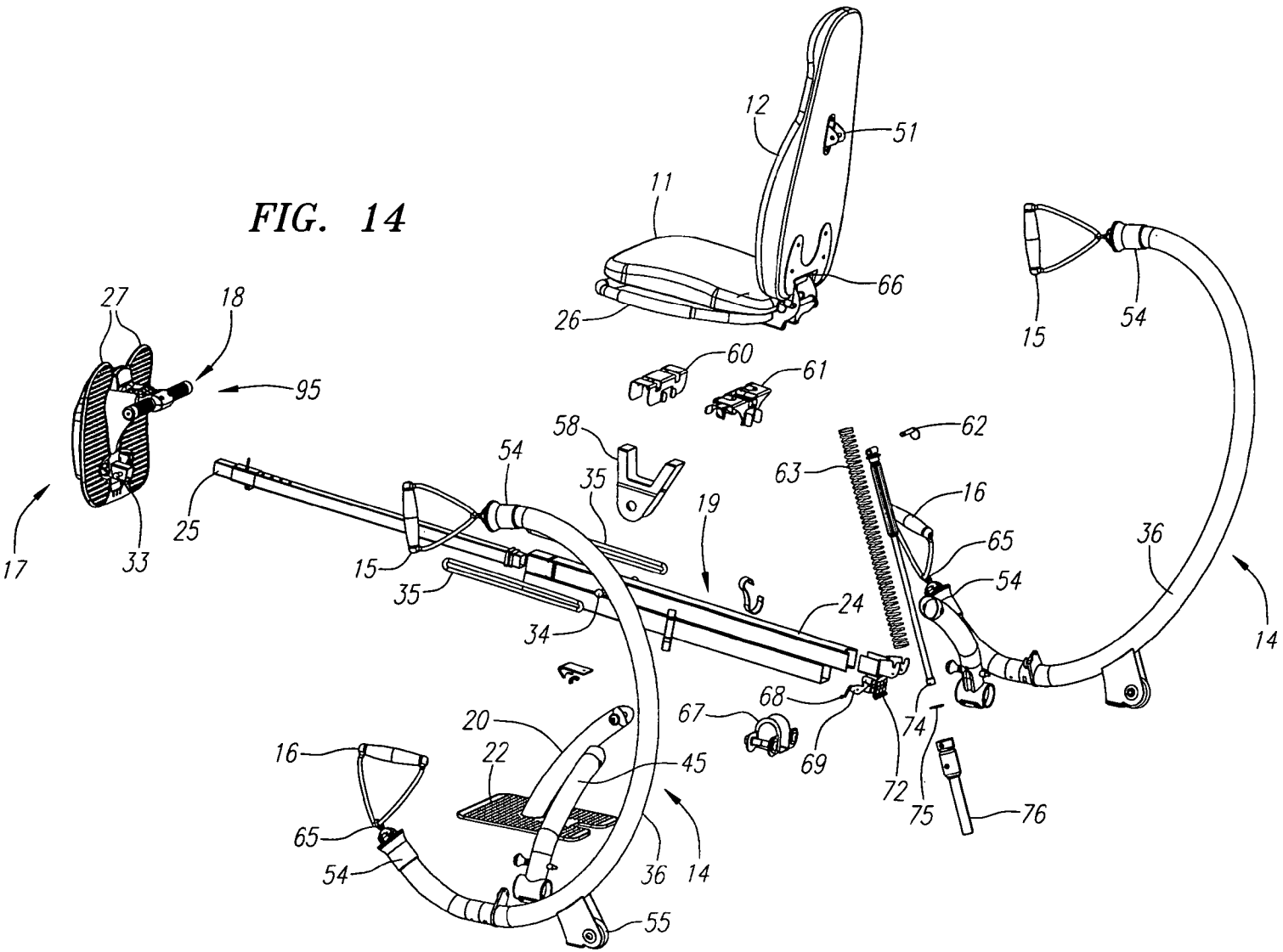
FIG. 14 is an exploded view of the exercise device in accordance with the present invention.

An embodiment of the device shown in FIGS. 1-3 is also shown in FIGS. 13-14, and some additional aspects of which are further shown in FIGS. 15-20. Where applicable, reference numerals for like components have been used throughout all of the drawings. Referring to FIGS. 1-3 (and also referring to FIGS. 13-14), an exercise device is shown in accordance with the present invention, comprising a base 10, a seat 11, a pivotally-resistant seat back 12 with resistive member 13 (FIG. 2), substantially hollow curvilinear lateral arms 14 with internal elastic bands connected to upper grips 15, and lower grips 16. The upper portion of resistive member 13 is attached to the back of seat back 12, as shown in FIG. 2, and the lower portion of resistive member 13 fits into a channel that runs directly beneath seat 11, where the lower, forward portion of resistive member 13 is held in place with threaded fastener 50, as shown in FIG. 11. The resistive member 13 is preferably made of any type of flexible yet resilient metal, capable of adequately supporting the seat back 12, which metal is flexible enough to permit movement of seat back 12 and resilient enough to provide resistance upon attempted movement of seat back 12. Other types of resistive members will also be readily recognized by skilled artisans, such as the use of compression or torsion springs, or any other type of elastic materials or devices. The seat 11 of the device depicted in FIGS. 13-14 is attached to the base 10 by way of brackets 60 and 61, and the resistive member is a seat spring assembly comprised of a seat back attachment plate 51, hitch pin 62, spring 63, hinge 66, seat spring latch rivet 68, seat spring latch 69, seat spring anchor 72, a rod 74, a washer 75, and a seat strut 76 (see FIG. 14).

Referring again to FIGS. 1-3 and 13-14, upper grips 15 and lower grips 16 are shown as enclosed handles, but any type of device or material permitting effective grasping by the user of the ends of the internal elastic bands is equally contemplated. The device further comprises a slideably-resistant foot platform 17 and seated-row grip 18 (see also FIGS. 17-20).

As shown in FIGS. 1-3, the base 10 comprises a longitudinal bar 19, which is fixedly attached atop a rearwardly-foldable forward leg stand 20 and a forwardly-foldable rear leg stand 21, each leg stand preferably being placed at an oblique angle with respect to longitudinal bar 19 for increased stability. Alternatively, as shown in FIGS. 13-14, the base 10 comprises a longitudinal bar 19, which is fixedly attached atop a rearwardly-foldable forward leg stand 20 with transverse foot 22, connected to longitudinal bar 19 by way of a front leg mount 58, with wheels 55 affixed to the lower portion of each curvilinear lateral arm, as shown in FIG. 14, such that the device is capable of being tilted back and rolled for ease of movement. As shown in FIGS. 1-3, the forward leg stand 20 is fixedly attached atop a transverse foot 22, and the rear leg stand 21 is fixedly attached atop a longer transverse foot 23, which preferably has an increased length for stability. As shown in FIGS. 1-3 and FIG. 14, the longitudinal bar 19 has an outer sleeve 24 slideably engaged with an inner sleeve 25. A handle 26 extends from, and is fixedly attached to, the longitudinal bar 19.

Figure 9:
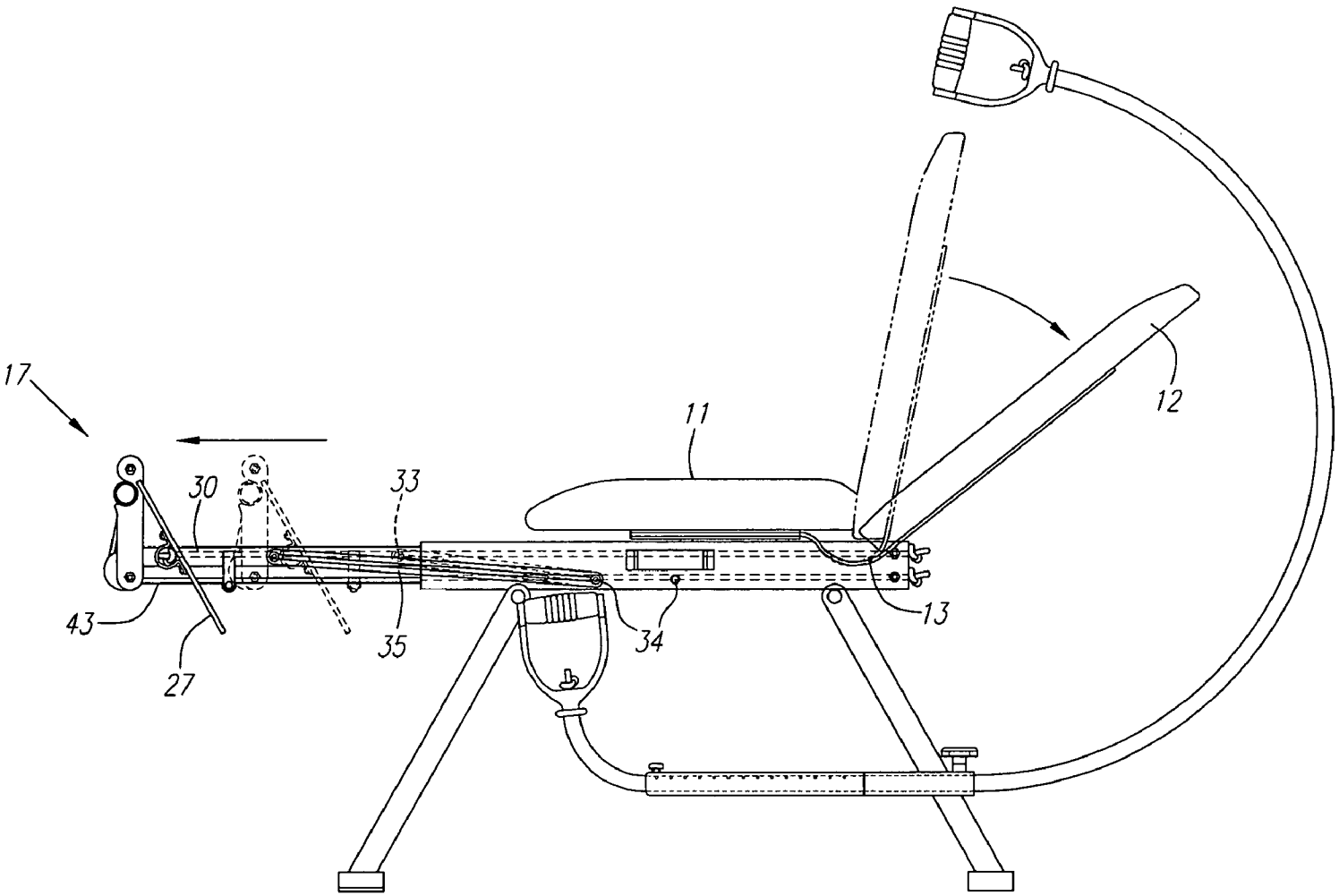
FIG. 9 is a side view of the exercise device in accordance with the present invention, showing the slideable function of the resistant foot platform and the pivotally-reclinable, resistant seat back. The internal elastic bands that pass beneath the seat are represented with dashed lines.

As shown in FIGS. 1-3, the foot platform 17 is comprised of foot rests 27, which are rotatably affixed with brackets 28 to a transverse hollow bar 29 that extends laterally on each side of longitudinal bar 19, which transverse bar 29 is fixedly attached substantially near the front end of longitudinal bar 19 at a right angle through inner sleeve 25. An alternative foot platform 27 is shown in FIGS. 13-14 and 19-20. As noted above, the outer sleeve 24 of longitudinal bar 19 is slideably engaged with inner sleeve 25, as can be seen in greater detail in FIGS. 4-6. As shown in FIG. 6, outer sleeve 24 has an upper channel and a lower channel, and inner sleeve 25 is fitted into and moves within the upper channel of outer sleeve 24. An elastic band 30, which runs through the length of the longitudinal bar 19, passes through an opening of the substantially closed rear end of the longitudinal bar 19, terminating in a knot 31. The other end of the elastic band 30 passes through the inner sleeve 25 of longitudinal bar 19 into the transverse hollow bar 29, terminating in a knot 32. A forward pin 33 is fixedly attached to the external side of the inner sleeve 25, and a series of rearward pins 34 are fixedly attached to the external side of the outer sleeve 24, each rearward pin 34 being placed at an increasingly greater distance from the forward pin 33. One end of a stretched, looped elastic band 35 is placed about the forward pin 33, and the other end of elastic band 35 is placed about one of the rearward pins 34. The slideable movement of the foot platform 19 is illustrated in FIG. 9. The configuration and operation of the alternative device shown in FIGS. 13-14 and 19-20 is substantially the same as that described above and as depicted in the figures cited above.

As shown in FIGS. 1-3, seat back 12 is pivotally-attached to the seat 11 by way of resistive member 13 that maintains the seat back 12 in a substantially upright position, and which provides resistance to any rearward movement of the seat back 12. The operation of the resistant seat back is illustrated in FIG. 9. The configuration and operation of the device depicted in FIGS. 13-14 is substantially the same as that described above and as depicted in the figures cited above, except that as noted, a spring 63 supplies the resistive force (see FIG. 14).

Figure 8:
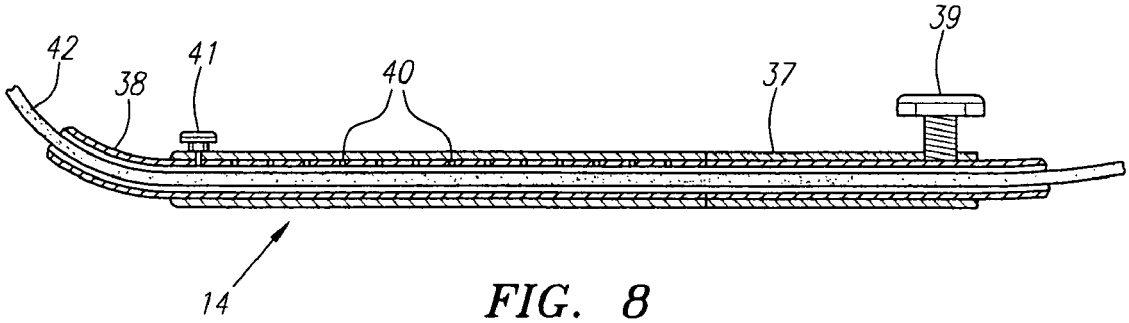
FIG. 8 is a side, cross-sectional view along line 8-8 of FIG. 1, showing the outer sleeve of the lower portion of the curvilinear arms, into which outer sleeve the curvilinear tubing fits; also shown is the threaded tightening knob for use in holding the curvilinear tubing or conduits firmly in place, which allow the curvilinear arms to be moved laterally upon loosening; also shown is the removable pin that allows the length of the curvilinear arms to be adjusted to increase or decrease elastic band tension.
Figure 10A:
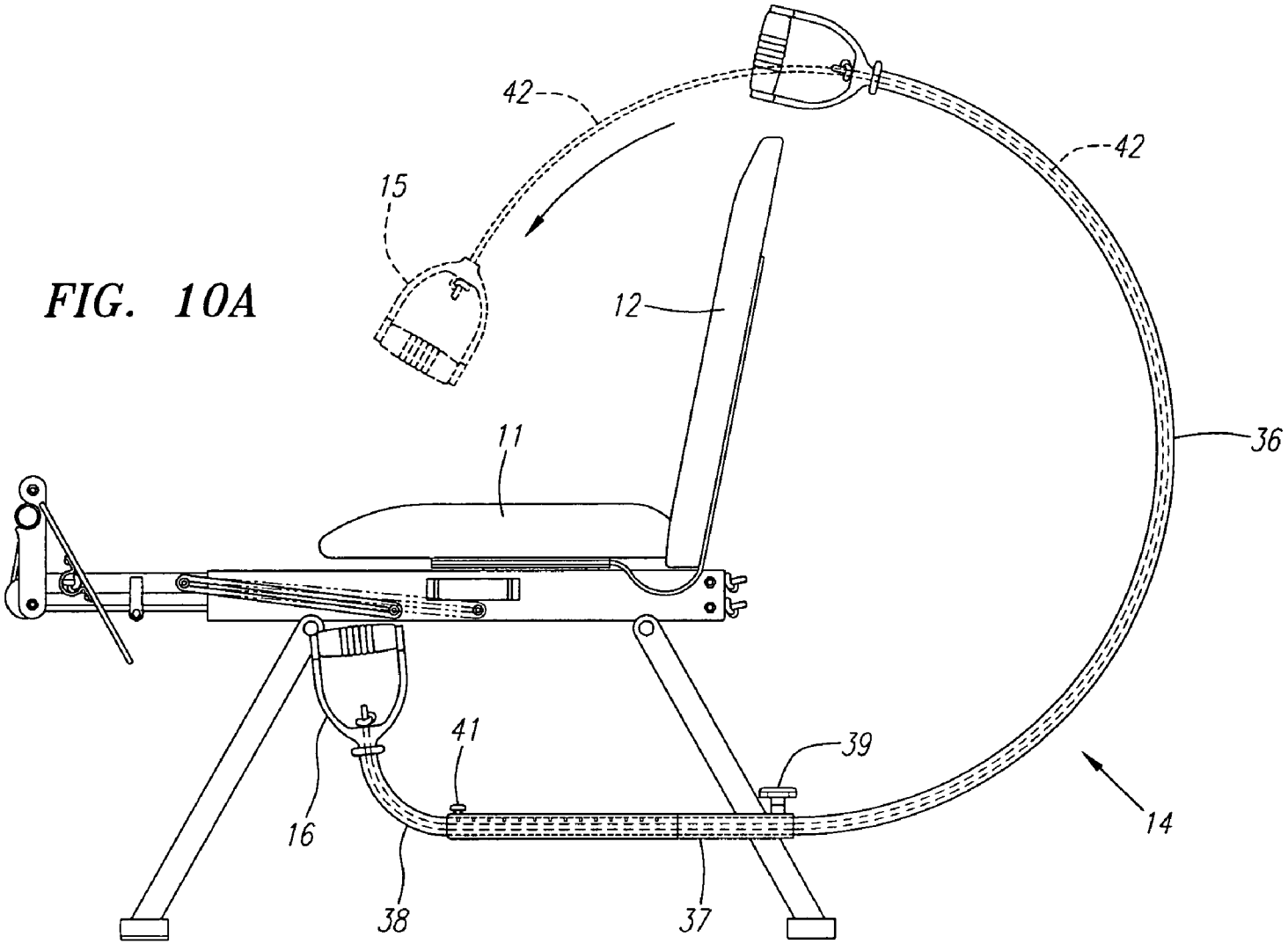
FIG. 10A is a side view of the exercise device in accordance with the present invention, showing the moveable operation of one of the upper grips, with dashed lines representing one of the internal elastic bands that passes through the length of the hollow curvilinear arms.
Figure 10B:
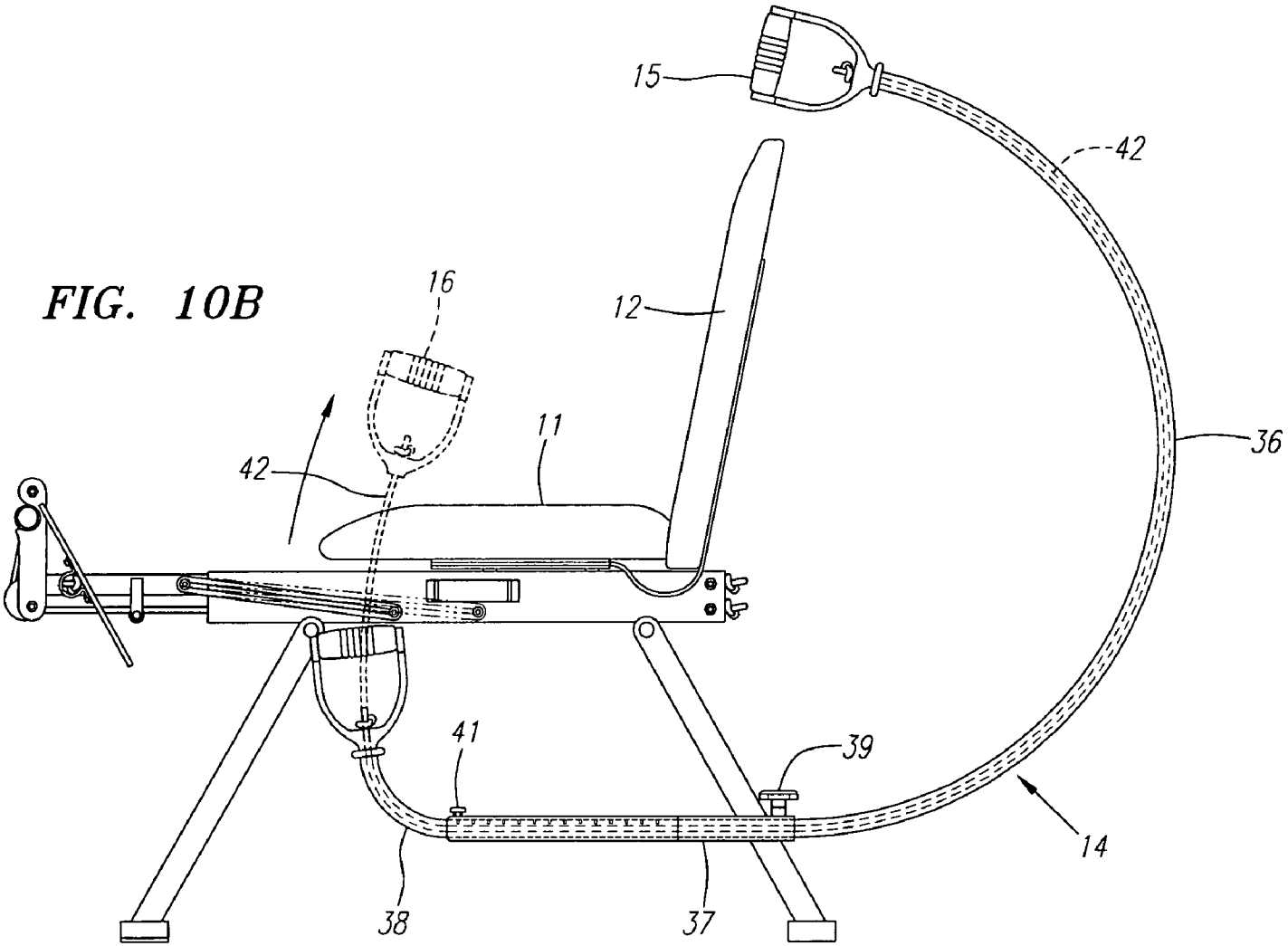
FIG. 10B is a side view of the exercise device in accordance with the present invention, showing the moveable operation of one of the lower grips, with dashed lines representing one of the internal elastic bands that passes through the length of the hollow curvilinear arms.

As shown in FIGS. 1-3, each curvilinear arm 14 is comprised of a rearwardly positioned upper tube 36, the lower end of which is slideably engaged with the rear opening of outer sleeve 37, and a separate, forwardly positioned lower tube 38, the lower end of which is slideably engaged with the front opening of outer sleeve 37. Upper tube 36 is held in place within outer sleeve 37 by threaded knob 39. Each curvilinear arm 14 is attached to rear transverse bar 45 which is in turn attached to rear leg stand 21. For the device depicted in FIGS. 13-14, transverse bar 45 is connected to longitudinal bar 19 by way of coupling 67. Lower tube 38 has a linear series of openings 40 across the upper surface of its substantially straight section, as can be seen in FIG. 8. Removable pin 41 can be placed through any one of the openings 40 in order to hold lower tube 38 in place at varying distances from outer sleeve 37. An elastic band 42 passes through the length of each of the curvilinear arms 14, one end of elastic band 42 emanating from an opening at the upper forward end of each upper tube 36 and connecting to upper grip 15, and the other end emanating from an opening at the upper forward end of each lower tube 38 and connecting to lower grip 16. Though not shown, one or more rollers can be placed along the curve of lower tube 38, which rollers interface with elastic band 42 in order to reduce wear and friction during movement of elastic band 42. Movement of upper grip 15 is illustrated in FIG. 10A, and movement of lower grip 16 is illustrated in FIG. 10B. The configuration and operation of the device depicted in FIGS. 13-14 is substantially the same as that described above and as depicted in the figures cited above.

Figure 4:
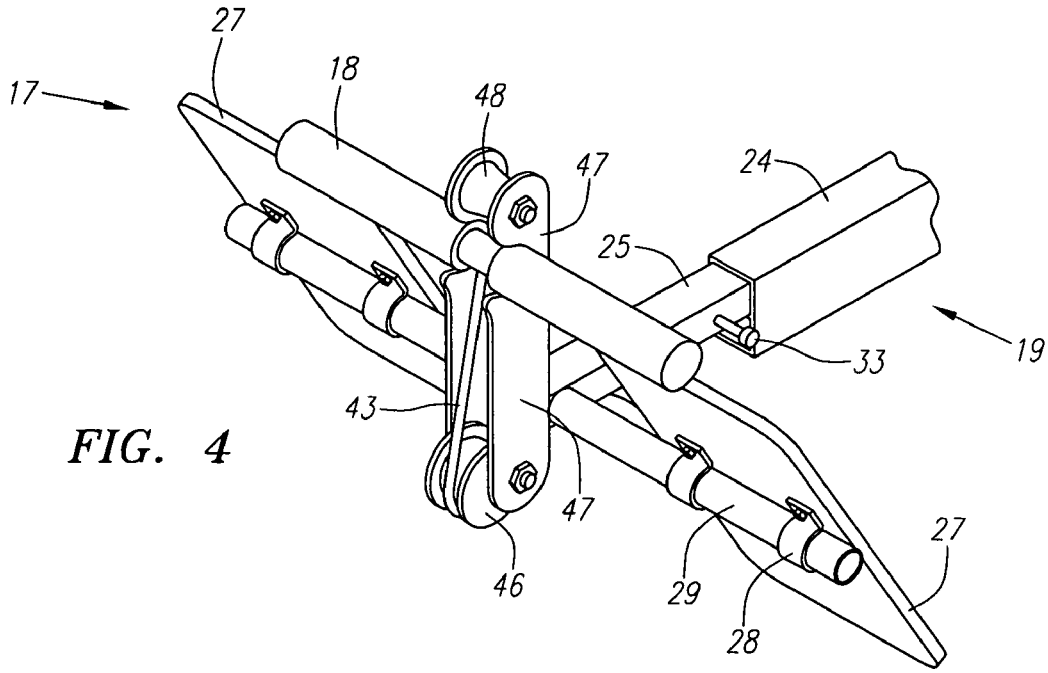
FIG. 4 is a front, perspective view of the foot platform and seated-row grip.
Figure 5:
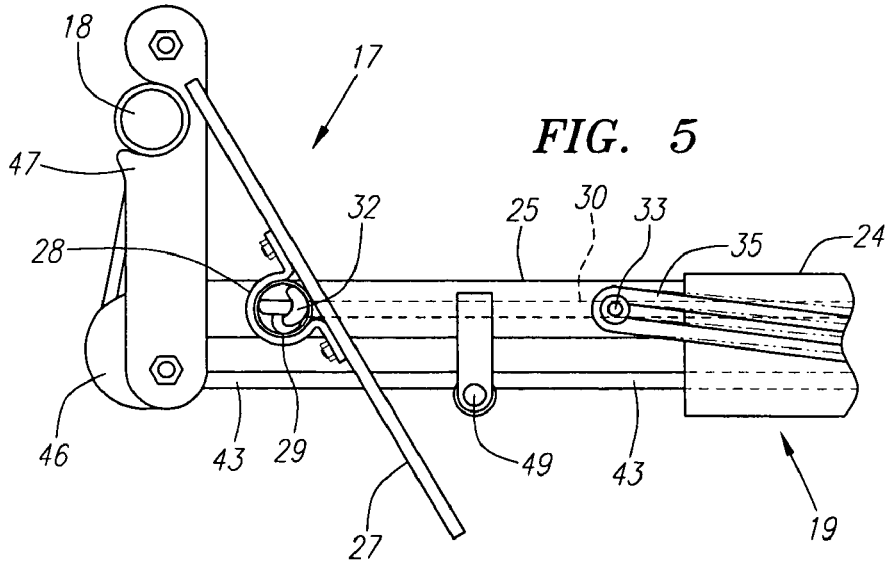
FIG. 5 is a side view of the foot platform and seated-row grip, with dashed lines representing the internal elastic bands; also shown is the outer elastic band for use in tension adjustment of the foot platform.
Figure 6:
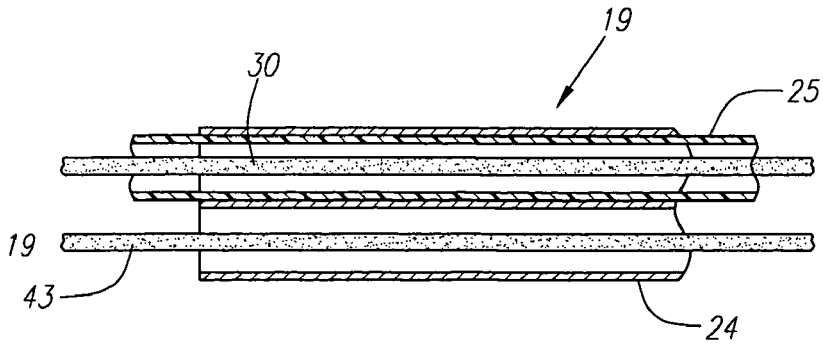
FIG. 6 is a side, cross-sectional view along line 6 of FIG. 2 showing a portion of the hollow longitudinal rail beneath the seat, through which passes an upper elastic band connected to the foot platform and a lower elastic band connected to the seated-row grip.

The seated-row grip 18 is shown in FIGS. 1-3, and in greater detail in FIGS. 4-6. The seated-row grip 18 is a transversely positioned bar that is connected to an elastic band 43 that runs the length of the longitudinal bar 19 through the lower channel of outer sleeve 24, and passes through an opening of the substantially closed rear end of the longitudinal bar 19, terminating in a knot 44. The other end of the elastic band 43 emanates from the substantially open front end of the lower channel of outer sleeve 24, where elastic band 43 passes around lower roller 46 and connects to the seated-row grip 18. While not in use, the seated-row grip 18 rests in holder 47, adjacent to an upper roller 48. During use, the elastic band 43 passes over and continuously or periodically engages with upper roller 48. A hanging roller 49 is positioned rearwardly from lower roller 46, and acts to hold elastic band 43 in place.

In operation, as illustrated in FIG. 9, the seat back 12 can be pivoted in a rearward direction while the user sits upon seat 11. Resistance during rearward movement is provided by resistive member 13 and can be used to effectively exercise the user's abdominal and other muscles. Also as illustrated in FIG. 9, the foot platform 17 can be moved in a forward direction against the resistance provided by both the internal elastic band 30, as well as by the external, adjustable elastic band 35. The tension of foot platform 17 can be increased by placing the elastic band 35 about two of the pins 33 and 34 that are spaced far apart, or the tension can be decreased by placing the elastic band 35 about two more closely spaced pins 33 and 34. By sitting in seat 11 and pressing and releasing the foot platform 17, the user is able to effectively exercise his or her leg and other muscles. Moreover, as described above, elastic bands of different tensions may be selected by rocking the rocker latches 101 when using the foot platform, and elastic bands of different tensions may be selected by rotating the latches 80 of connecting port 54.

As illustrated in FIGS. 10A and 10B, the arm and back muscles can be exercised by pulling any combination of upper grips 15 or lower grips 16. The tension on these grips can be altered by adjusting the lower tube 38. This is accomplished by removing pin 41 from an opening 40 and extending or retracting the lower tube 38 from outer sleeve 37. Removable pin 41 is then replaced back into the corresponding opening 40, thus fixing lower tube 38 in place. By so extending or retracting lower tube 38, the length of the internal elastic bands 42 that run through the conduit formed by the curvilinear arms 14 is increased or decreased, thus changing the amount of resistance during exercise. As described above, the aforementioned exercises can be performed simultaneously, in conjunction with abdominal and leg muscle exercises, as part of single workout routine.

Figure 12:
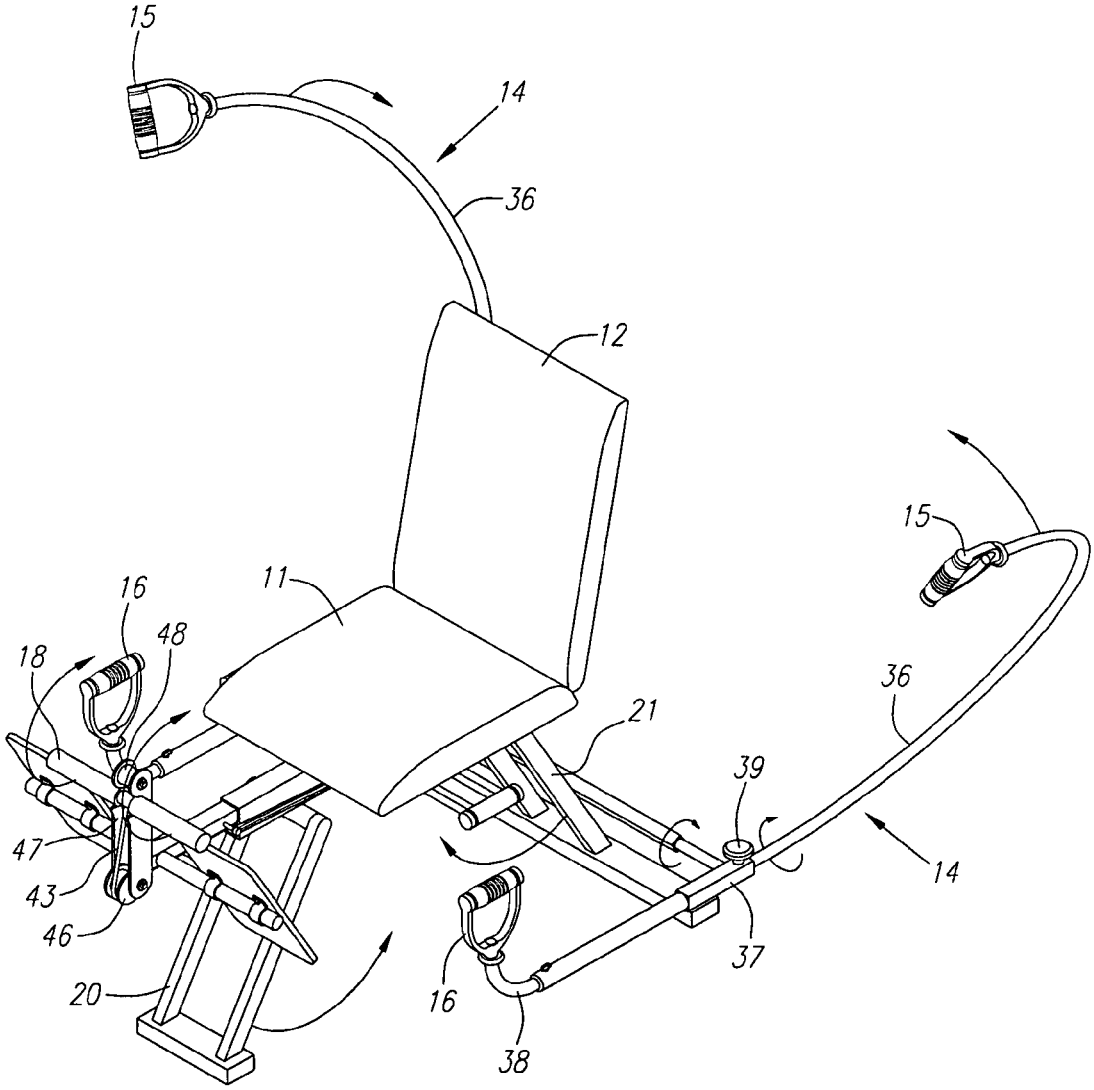
FIG. 12 is a front, perspective view of the exercise device in accordance with the present invention, showing the curvilinear arms rotated outwardly about the axis of line 8-8 in FIG. 1, which outward rotation is for configuring the device to perform butterfly-type arm exercises, in accordance with the present invention.

Further, as illustrated in FIG. 12, the upper tube 36 can be rotated outwardly in a lateral direction by releasing and then tightening threaded knob 39. This configuration permits the user to perform butterfly-type arm exercises, thus exercising the user's arm, pectoral, and other muscles.

In addition, the user can attain a cardiovascular workout by performing a seated-row type exercise. This is accomplished by sitting in seat 11 and pulling and releasing the seated-row grip 18, the movement of which is made resistant by elastic band 43. For added stability the user can hold fast to handle 26. This exercise permits the user to attain a cardiovascular exercise workout, inasmuch it causes an effective increase in the user's heart rate through whole body movement.

The present invention can further be made compact for portability or storage. This is accomplished by releasing threaded knobs 39, laterally rotating the upper tube 36 inwardly, folding the forward leg 20 and rear leg 21 upwardly against the bottom of seat 11, as shown by arrows in FIG. 12. Referring to FIG. 11, seat back 12 can be easily removed by removing threaded fastener 50, and then rearwardly sliding the lower, forward portion of resistive element 13 out of the channel located between the seat 11 and longitudinal bar 19.

Figure 7:
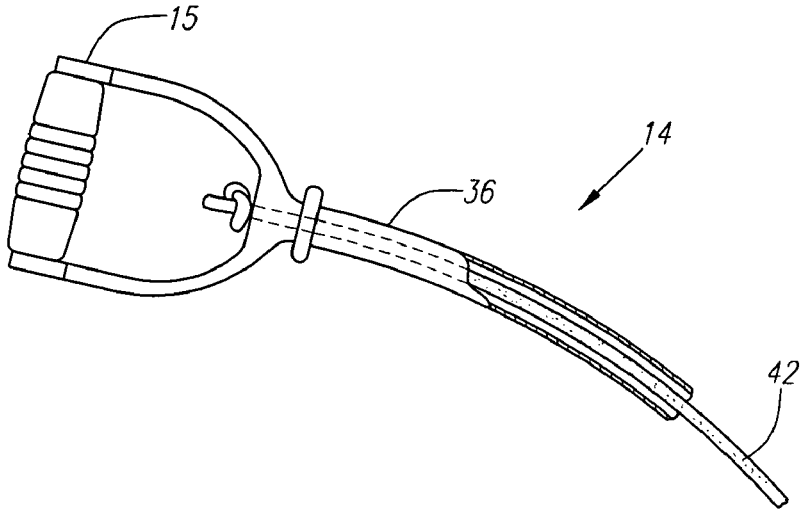
FIG. 7 is a side view of the encircled portion 7 of FIG. 3, showing an upper portion of one of the hollow curvilinear arms, with partial cross-section along the plane formed by the circle 7 of FIG. 3, showing the interior of the hollow arms through which passes an elastic band connected to an upper grip (shown) and lower grip.
Figures 15, 16:
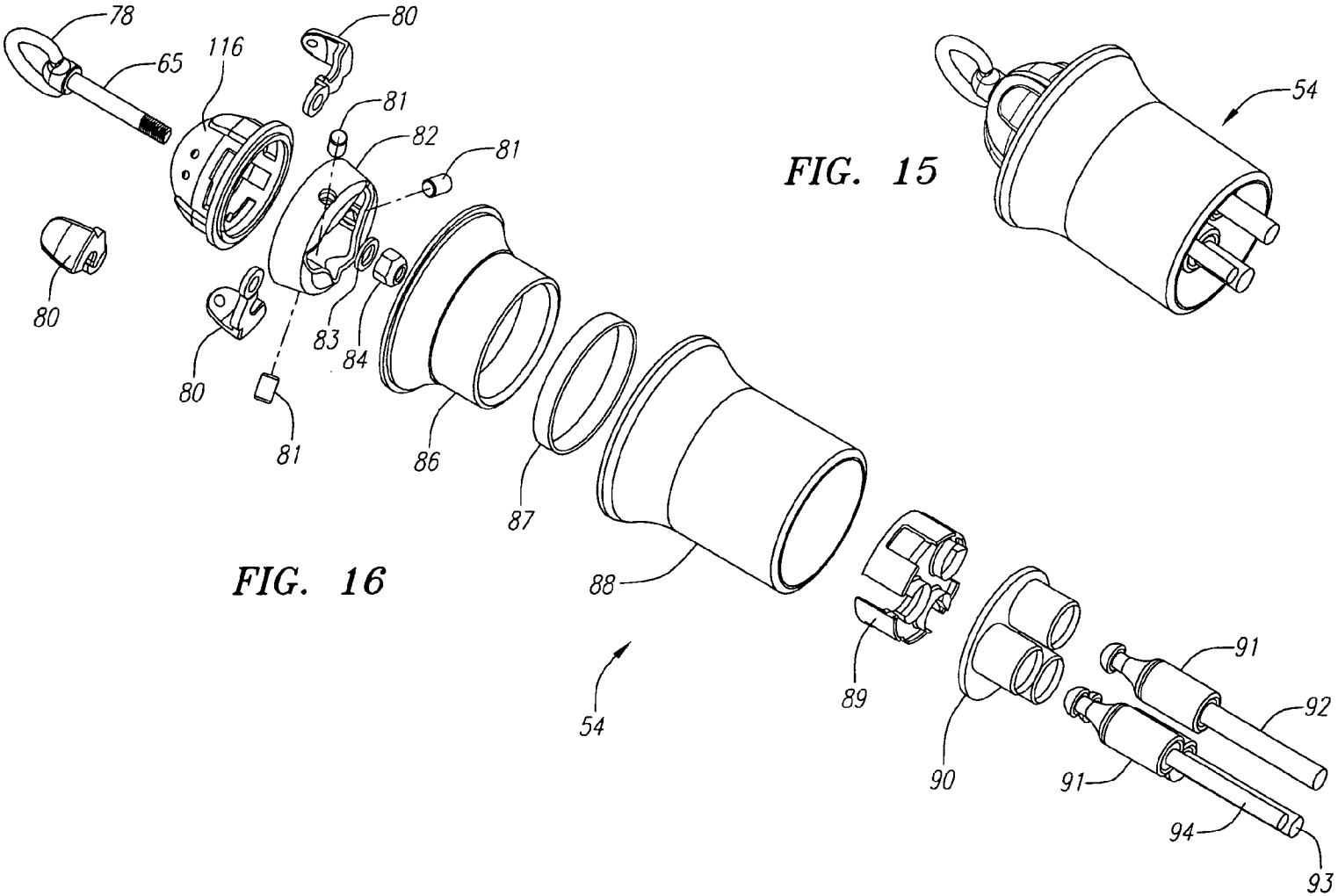
FIG. 15 is a perspective view of the curvilinear grip coupling port in accordance with the present invention.
FIG. 16 is an exploded view of the curvilinear grip coupling port in accordance with the present invention.

In another aspect of the invention, as shown in FIGS. 13-14, and more fully in FIGS. 15-16, a connecting port 54 for engaging the handles 15 and 16 with one or more elastic bands of different tensions is shown, which connecting port 54 is positioned at the ends of curvilinear conduits 36. As can be seen in FIG. 16, elastic bands 92-94 of different tensions are shown attached to heads 91. Elastic bands 92-94 pass through curvilinear conduits 36 (FIGS. 13-14, and as analogously shown in FIGS. 3 and 7-8). Connecting port 54 includes connector ring 78 and drawbolt 65 (to which handles 15 and 16 are attached, as shown in FIGS. 13 and 14). Drawbolt 65 passes through outer cap 116, inner base 82, three latches 80, washer 83, and it threads through nut 84. Magnets 81 fit into inner base 82 as shown. End cap bugle insert 86 and ferrous ring 87 fit into the wider opening of end cap bugle 88. Guide plate 89 and bottom plate 90 fit into the smaller opening of end cap bugle 88, and the openings of either or both of guide plate 89 and bottom plate 90 are sized such that heads 91 cannot pass through, thus preventing escape of the elastic bands 92-94 from the connecting port 54 into the curvilinear conduits. The cutout or notched openings of latches 80 are sized such that they are large enough to fit snugly around the narrow middle portion of heads 91, so as to hold heads 91 in place. In operation, the user rotates one or more of latches 80 such that the cutout or notched opening of the latch 80 engages with the head 91. The user then grasps handles 15 or 16 (FIGS. 13-14) and pulls the handles 15 or 16, thus pulling the elastic band or bands and head or heads 91 out of the connector port 54. When the user is finished pulling, the user can subsequently rotate the latches to engage or disengage one or more of the differently tensioned elastic bands 92-94, thus permitting the user to quickly change the elastic band tension.

Figures 17, 18:
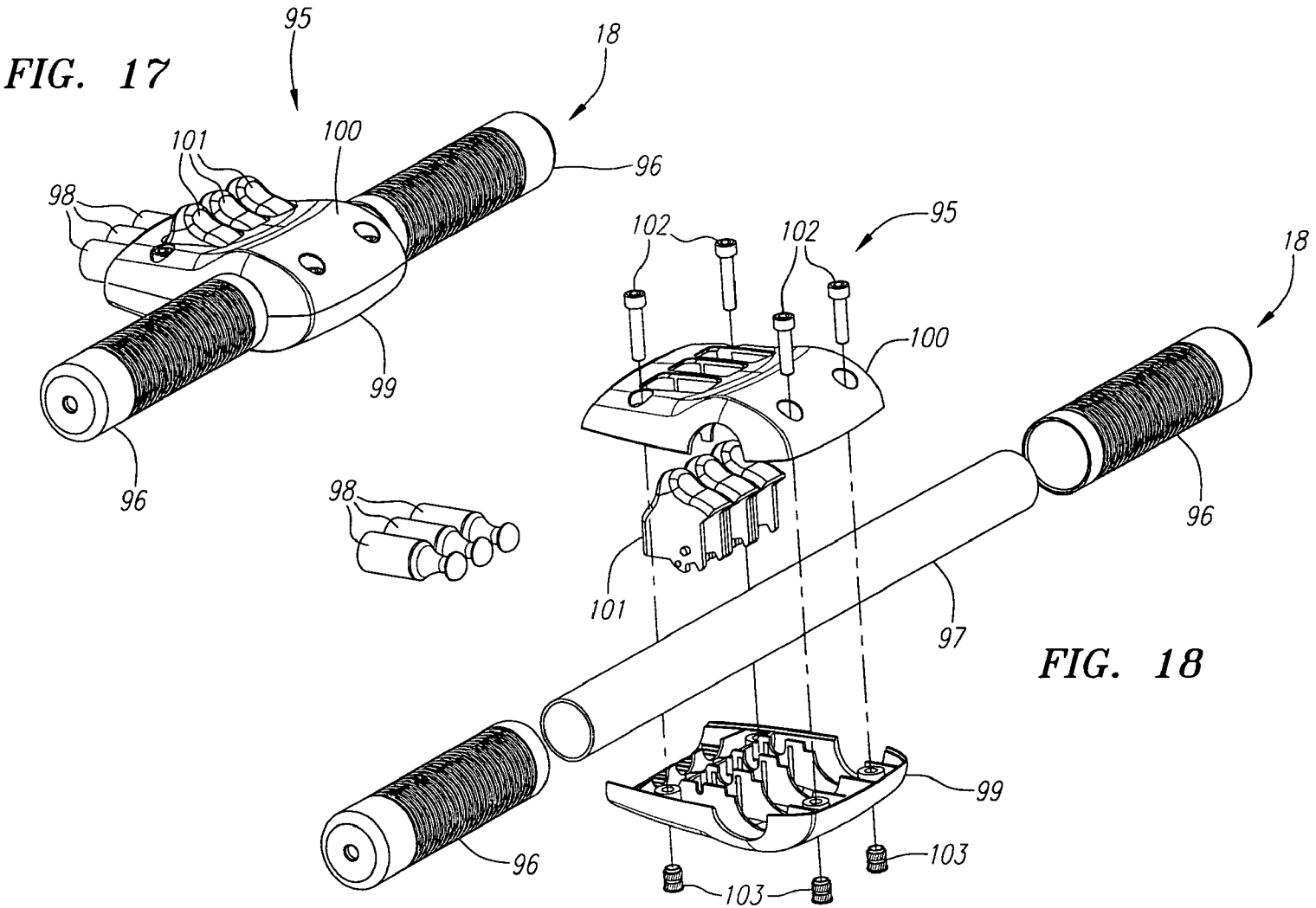
FIG. 17 is a perspective view of the seated row grip coupling mechanism in accordance with the present invention.
FIG. 18 is an exploded view of the seated row grip coupling mechanism in accordance with the present invention.

In another aspect of the invention, depicted in FIGS. 13-14, and more fully in FIGS. 17-20, a seated row assembly 95 is shown attached to foot platform 17 (see FIGS. 19-20). Referring to FIGS. 17-18, grips 96 are attached to transverse bar 97. Heads 98 are attached to the ends of a like number of elastic bands that run the length of longitudinal bar 19 (FIGS. 13-14, and similarly FIGS. 3-6). Rocker latches 101 are fitted to lower housing 99. Upper housing 100 fits atop lower housing 99, and are held together by pins 102 and nuts 103. Rocker latches 101 are able to be moved forwardly or rearwardly in order that the opening of rocker latches 101 fits snugly around the narrow middle portion of heads 98, thus allowing the user to readily and easily select one or more elastic bands of varying tensions. Referring to the foot platform 17 depicted in FIGS. 19-20, seated row assembly 95 is shown attached to foot platform 17, which includes an outer housing 115, foot plate 27 attached to backing plate 106 by screws 107, and a leg press bungle hook 111. Foot plate 27 may be any type of hard or soft material that is useful to grip the foot during movement of the foot platform 17. Sleeve 115 fits over inner sleeve 25, and elastic bands 35 fit around pins 33, as can more fully be seen in FIG. 14 (and analogously in FIGS. 1-3). As depicted in FIGS. 19-20, three elastic bands with a head 98 at one end run the length of the longitudinal bar 19 (as analogously shown in FIGS. 1-3). The elastic bands pass around upper and lower pulleys 108, which are attached to the foot platform 17 by way of pins 109, nuts 110, and washers 114, whereupon pins 109 pass through an upper foot plate cross support 112 and a lower foot plate cross support 113, attaching the foot plate cross supports 112 and 113 to foot platform 17. Foot plate cover 104 is attached to outer housing 115, and elastic band stop 105 is attached to foot plate cover 104, which elastic band stop 105 prevents escape of elastic band because elastic band stop 105 is sized such that head 98 cannot pass through the openings of elastic band stop 105.

Although particular embodiments of the invention have been described and illustrated herein in detail, it is recognized that modifications may readily occur to those skilled in the art. Consequently, it is intended that the claims herein be interpreted to cover any such modifications. It is further intended that the present invention be not limited according to the disclosed embodiment, but rather only according to the appended claims.

What is claimed is:

1. A tension selector on an exercise device comprising:

a plurality of resistive elements, each of said resistive elements having a first end and a second end;

said first end of at least one of said resistive elements passing through a portion of a curvilinear conduit;

a plurality of heads, at least one of said heads being connected to the second end of one of said resistive elements, each of said heads further including a narrowed middle portion;

at least one rotatably-moveable latch connected proximate one end of said curvilinear conduit, said latch having an opening that is larger than said narrowed middle portion of said head connected to the second end of one of said resistive elements, said latch being positioned proximate said head connected to the second end of one of said resistive elements so as to engage and disengage said head connected to the second end of one of said resistive elements.

2. The tension selector according to claim 1, wherein a handle is connected to said latch.

3. The tension selector according to claim 1, wherein at least one of said resistive elements comprises an elastic band.

4. The tension selector according to claim 1, wherein said plurality of heads are located within a housing.

5. The tension selector according to claim 1, wherein said latch is held in position by at least one threaded bolt.

6. A tension selector on an exercise device comprising:

a plurality of resistive elements, each of said resistive elements having a first end and a second end;

said first end of at least one of said resistive elements passing through a portion of a conduit, said conduit including a housing connected adjacent said conduit;

a plurality of heads, at least one of said heads being connected to the second end of one of said resistive elements, each of said heads further including a narrowed middle portion;

at least one latch connected proximate said housing, said latch adapted to move by rocking, said latch having an opening that is larger than said narrowed middle portion of said head connected to the second end of one of said resistive elements, said latch being positioned proximate said head connected to the second end of one of said resistive elements so as to engage and disengage said head connected to the second end of one of said resistive elements.

7. The tension selector according to claim 6, wherein at least one of said resistive elements comprises an elastic band.

8. The tension selector according to claim 7, wherein said elastic band passes around at least one pulley.

9. The tension selector according to claim 8, wherein said pulley is located within said housing.

* * * * *